US012576439B2

(12) United States Patent
Kotaki et al.

(10) Patent No.: US 12,576,439 B2
(45) Date of Patent: Mar. 17, 2026

(54) TUBE BENDING SYSTEM

(71) Applicant: SANOH INDUSTRIAL CO., LTD., Tokyo (JP)

(72) Inventors: Yuichi Kotaki, Ibaraki (JP); Atsushi Takahashi, Ibaraki (JP); Ru Yi, Ibaraki (JP); Shenghua Luan, Ibaraki (JP)

(73) Assignee: SANOH INDUSTRIAL CO., LTD., Tokyo (JP)

( * ) Notice: Subject to any disclaimer, the term of this patent is extended or adjusted under 35 U.S.C. 154(b) by 273 days.

(21) Appl. No.: 18/275,916

(22) PCT Filed: Feb. 14, 2022

(86) PCT No.: PCT/JP2022/005743

§ 371 (c)(1),
(2) Date: Aug. 4, 2023

(87) PCT Pub. No.: WO2022/173048

PCT Pub. Date: Aug. 18, 2022

(65) Prior Publication Data

US 2025/0010349 A1 Jan. 9, 2025

(30) Foreign Application Priority Data

Feb. 15, 2021 (JP) ..... 2021-064470

(51) Int. Cl.
*B21D 7/12* (2006.01)
*B21D 43/00* (2006.01)

(52) U.S. Cl.
CPC ..... *B21D 7/12* (2013.01); *B21D 43/006* (2013.01)

(58) Field of Classification Search
CPC ... B21D 7/00; B21D 7/02; B21D 7/12; B21D 43/006; G06T 1/0014
See application file for complete search history.

(56) References Cited

U.S. PATENT DOCUMENTS 3,431,759 A * 3/1969 Whittingham ..... B21D 7/06 72/422
3,874,048 A * 4/1975 Millar ..... B21D 43/05 29/430

(Continued)

FOREIGN PATENT DOCUMENTS

CN 112222311 A 1/2021
JP 5-062783 U1 8/1993

(Continued)

OTHER PUBLICATIONS

KR 20170014301A, Gu Feb. 2017.*

(Continued)

*Primary Examiner* — Edward T Tolan
(74) *Attorney, Agent, or Firm* — MARSHALL, GERSTEIN & BORUN LLP

(57) ABSTRACT

A tube bending system for bending a processing target tube that includes a metal tube and two flare nuts into a specific shape, with the tube bending system including a bending machine and a tube delivery unit. The tube delivery unit includes a shift-to-end mechanism that performs a shift-to-end manipulation on the processing target tube to move the two flare nuts to the end portion sides of the processing target tube such that one of the two flare nuts abuts one of the two ring-shaped projections and the other of the two flare nuts abuts the other of the two ring-shaped projections, and an inspection mechanism that utilizes the shift-to-end manipulation to detect an abnormality of the processing target tube that is to be bent in the bending machine.

12 Claims, 14 Drawing Sheets

(56) References Cited

U.S. PATENT DOCUMENTS

| | | | | |
|---|---|---|---|---|
| 5,005,274 | A * | 4/1991 | Timell | B65H 75/50 29/33 P |
| 5,544,404 | A * | 8/1996 | Brunnhofer | B60K 15/01 29/445 |
| 7,350,389 | B2 * | 4/2008 | Reissenweber | B21J 13/10 72/305 |
| 2006/0254336 | A1 * | 11/2006 | Rosenberger | B21D 7/12 72/306 |
| 2018/0229709 | A1 | 8/2018 | Glidewell et al. | |

FOREIGN PATENT DOCUMENTS

| | | | |
|---|---|---|---|
| JP | 3-148663 | B2 | 3/2001 |
| JP | 2001-173851 | A | 6/2001 |
| JP | 2020-133891 | A | 8/2020 |
| JP | 7-275957 | B2 | 5/2023 |

OTHER PUBLICATIONS

Translation KR 20170014301A, Gu Feb. 2017.*
International Search Report and Written Opinion for Application No. PCT/JP2022/005743, dated Apr. 5, 2022.
Office Action issued in Chinese Patent Application No. 2022800264712 dated Dec. 5, 2025.

* cited by examiner

TUBE BENDING SYSTEM

TECHNICAL FIELD

The present disclosure relates to a tube bending system.

BACKGROUND ART

Automobile brake tubes are widely known as an application for metal multiplex tubing. Brake tubes are bent in three dimensions so as to be compatible with an underfloor profile of a vehicle. In order to couple such tubes to various devices, a ring-shaped projection is formed at the two end portions of the tubes, and flare nuts are mounted thereto so as to abut the ring-shaped projections. The tube is coupled to various devices by fastening a flare nut in a state in which an end portion of the tube has been inserted into such a device. Such tube bending is generally performed in a state in which two compatible flare nuts are mounted to the two end portions of the tube. A device such as that of Japanese Patent No. 3148663, for example, is known as a device for bending metal tubes.

SUMMARY OF INVENTION

Technical Problem

The shapes of bent tubes are predominantly left-right asymmetrical. There are often cases of specifications having different types of flare nut mounted to each end of the tube. There is accordingly often a left-right discrimination for tubes subjected to bending. For example, if a tube delivered into a bending machine in a left-right reversed orientation with respect to the correct orientation is nevertheless bent, then this results in the generation of a defective product in which incompatible flare nuts are mounted to each end thereof. Moreover, in a situation in which a flare nut should be mounted in a direction in which a thread portion side abuts a ring-shaped projection, a defective product is also produced when the tube has been bent with the flare nut mis-mounted so as to face in the opposite direction with a head portion side abutting the ring-shaped projection.

An object of the present disclosure is to provide a tube bending system enabling generation of defective product to be prevented prior to bending.

Solution to Problem

A tube bending system of the present disclosure is a tube bending system for bending a processing target tube into a predetermined shape, the processing target tube including a metal tube having two ring-shaped projections, respectively formed at each of two end portions of the metal tube, and including two flare nuts respectively mounted at an outer periphery of the metal tube so as to correspond to one or another of the two ring-shaped projections. The tube bending system includes a bending machine that bends the processing target tube, and a tube delivery unit that receives the processing target tube and delivers the processing target tube to the bending machine. The tube delivery unit includes a shift-to-end mechanism that performs a shift-to-end manipulation on the processing target tube to move the two flare nuts to the end portion sides of the processing target tube such that one of the two flare nuts abuts one of the two ring-shaped projections and the other of the two flare nuts abuts the other of the two ring-shaped projections, and an inspection mechanism that utilizes the shift-to-end manipulation to detect an abnormality of the processing target tube that is to be bent in the bending machine.

In this tube bending system, the shift-to-end manipulation, which is performed in a process from the processing target tube being received by the tube delivery unit to being bend by the bending machine, is utilized to detect an abnormality of the processing target tube. A dedicated physical manipulation for inspecting the processing target tube is not needed, enabling suppression of a drop in throughput that would arise were an inspection process to be incorporated into the system. Moreover, an abnormality of the processing target tube can be detected at a stage prior to delivery to the bending machine, enabling generation of defective product to be prevented prior to bending.

An aspect of the present disclosure may be configured such that the inspection mechanism includes a stage on which the processing target tube positioned by the shift-to-end manipulation is disposed, an image capture means that outputs image data obtained by capturing an image of an image capture range including the flare nut set on the stage and that has a fixed positional relationship to the stage, an image capture control means that controls the image capture means so as to capture an image of the image capture range in a state in which the processing target tube is positioned on the stage, and an abnormality detection means that detects the abnormality of the processing target tube based on the image data.

In this aspect the positional relationship between the stage and the image capture means is fixed, and so the image capture range set on the stage is constant. This enables an abnormality to be detected merely by comparing a position of each portion of the processing target tube positioned on the stage against a normal position of each portion. There is no need to ascertain a dimension and shape of the processing target tube subject to inspection from the image data.

The shift-to-end mechanism may be any suitable configuration. For example, the shift-to-end mechanism may be configured including a left-right pair of tube reception members that are each formed with a reception groove having a width that is larger than an outer diameter of the processing target tube and smaller than an outer diameter of a flare nut, that each receive the processing target tube at an opposite side of the flare nut from the ring-shaped projection, and that are movable in an axial direction, and including a drive means configured to independently drive the left-right pair of tube reception members, wherein the processing target tube is positioned on the stage by moving one of the left-right pair of tube reception members to a specific position on the stage, and moving the other of the left-right pair of tube reception members in a direction away from the stage.

An aspect of the present disclosure may be configured such that the processing target tube is prepared as a product to be mounted with different types of flare nut having mutually different axial directional dimensions as the two flare nuts, and as the abnormality, the abnormality, detection means detects a tube delivery abnormality when the tube delivery unit has received the processing target tube in a state of reversed left-right orientation.

The processing target tube has a left-right discrimination in cases in which flare nuts having mutually different axial direction dimensions are mounted to the two ends of the processing target tube. In this aspect a processing target tube that has been delivered with the reversed left-right orientation is able to be detected as a tube delivery abnormality prior to bending. This enables prevention of a situation in which a defective product is generated by mis-delivery even though the processing target tube is itself a good product. A good product can accordingly then be manufactured by re-delivery of the processing target tube that had a tube delivery abnormality, this time with the correct orientation.

In this aspect, the abnormality detection means may be configured so as to detect the tube delivery abnormality by identifying a position of a terminal end of the processing target tube based on the image data. Moreover, a configuration may be adopted in which a surface of the processing target tube is covered in a covering layer, and the covering layer is peeled off from respective two terminal ends of the processing target tube by a different length at left and right in accordance with the respective axial directional dimensions of the two flare nuts, and based on the image data the abnormality detection means detects the tube delivery abnormality by identifying a boundary position between a peeled range where the covering layer has been peeled off and a non-peeled range where the covering layer has not been peeled off. The processing target tube is positioned on the stage, and so a difference arises between these boundary positions when normal and when abnormal. This enables the tube delivery abnormality to be detected by identifying these positions.

An aspect of the present disclosure may be configured such that as the abnormality, the abnormality detection means detects a nut mounting direction abnormality in which at least one of the two flare nuts has been abutted against the ring-shaped projection in a reversed orientation from a correct direction. In such cases a defective product not able to be coupled to a coupling target tube can be prevented from being generated.

This aspect may be configured such that each flare nut includes a thread portion formed with a male thread and a head portion adjacent to the thread portion, and the abnormality detection means detects the nut mounting direction abnormality by partitioning the image data including an image of the flare nut into an outside area at a leading end side and an inside area at an opposite side, comparing a variation of brightness values in the outside area against a variation of brightness values in the inside area, and inferring whether or not the thread portion is present on the outside area side based on a magnitude relationship between the respective variations.

This aspect enables inference of whether or not the thread portion is on the leading end side by partitioning variation in brightness values inside the image data into two, and comparing the magnitude relationship between the variations in these areas. A nut mounting direction abnormality can be detected by processing simpler than processing using the image data to ascertain a feature such as a shape and dimension of the flare nut to discriminate between the thread portion and the head portion.

An aspect of the present disclosure may be configured such that the tube delivery unit further includes a transport mechanism that transports the processing target tube to the bending machine after the shift-to-end manipulation, and the transport mechanism does not transport the processing target tube to the bending machine in a cases in which the inspection mechanism has detected the abnormality and, instead, transports the processing target tube to a collection means provided within an operational range of the transport mechanism.

The present disclosure enables defective product to be prevented from being generated prior to bending.

DESCRIPTION OF EMBODIMENTS

As an example, an automobile brake tube is a metal tube employed as a pipe to transmit pressure generated by a master cylinder to a brake unit provided to each wheel. High pressure terminal end processing is performed in a state in which a flare nut has been mounted to the terminal end of a brake tube. Examples of high pressure terminal end processing include, for example, terminal end processing to form a ring-shaped projection such as an ISO flare as specified by the International Standards Organization (ISO), a double flare as specified by the Japanese Automotive Standards Organization (JASO), or the like. Terminal end processing is performed on a brake tube to form a ring-shaped projection in a state in which a flare nut is mounted to the outer periphery thereof, and three-dimensional bending is performed thereon to match an automobile floor profile or the like.

Figure 1A:
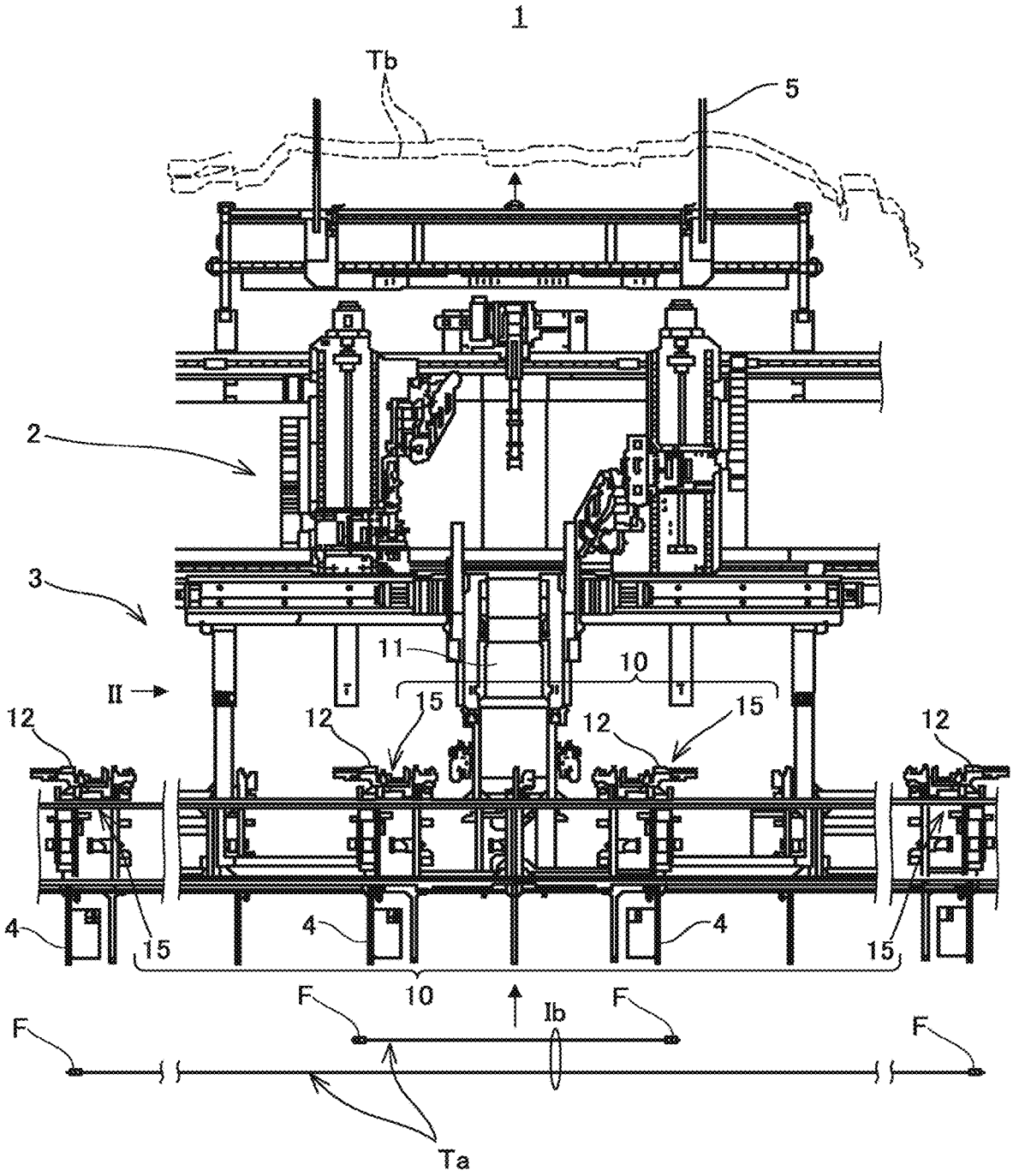
FIG. 1A is a plan view illustrating an overall configuration of a tube bending system.

FIG. 1A is a plan view illustrating an overall configuration of a tube bending system. A tube bending system (hereafter referred to as a processing system) 1 includes a bending machine 2 to bend a processing target tube Ta (see FIG. 1B) into a specific shape, and a tube delivery unit 3 for receiving the processing target tube Ta and delivering it into the bending machine 2. The processing system 1 has an overall length that enables bending of plural different types of processing target tube Ta. The processing target tube Ta is transferred by an operator (omitted in the drawings) of the tube delivery unit 3 into a tube input section 4. A post-processing tube Tb that has been bent by the bending machine 2 is then collected in a collection section 5 provided to the bending machine 2.

Figure 1B:
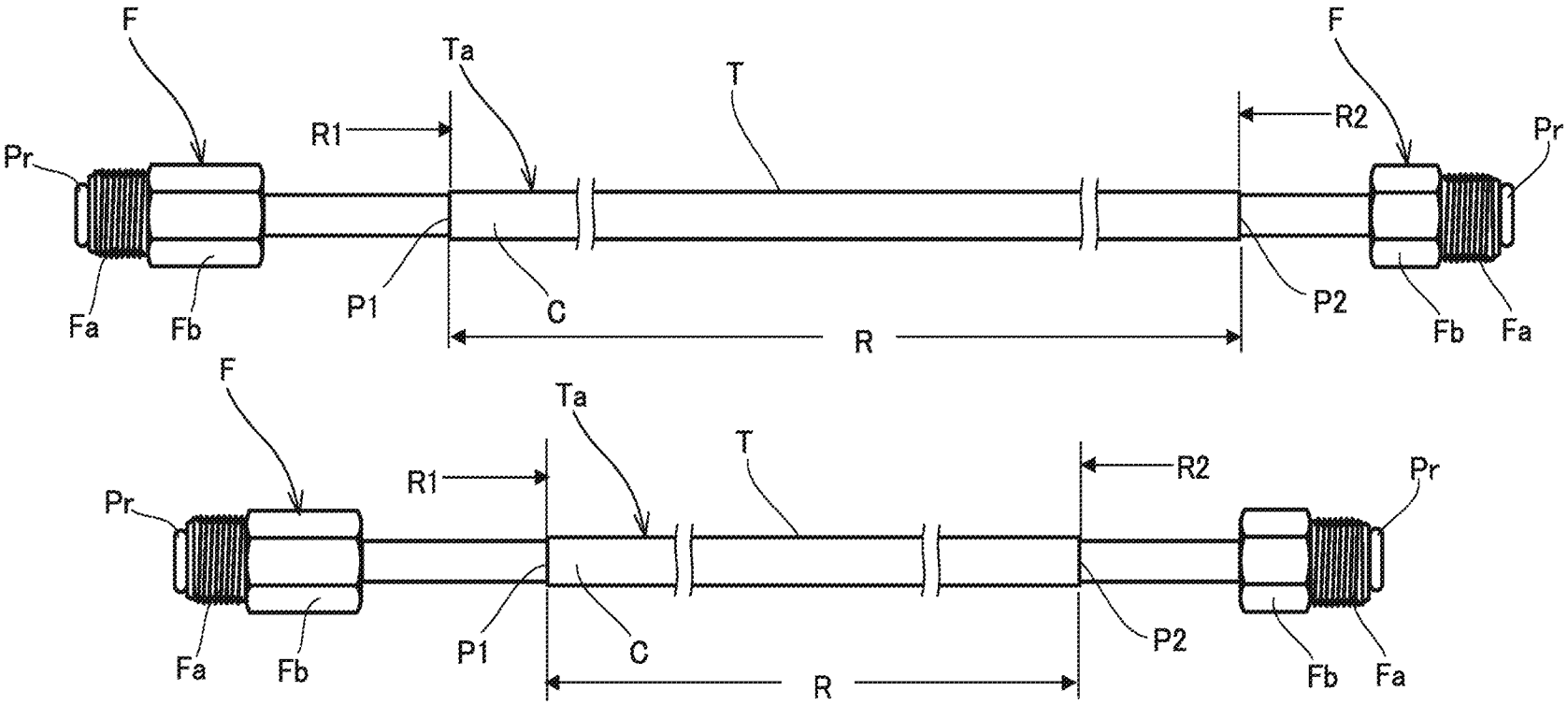
FIG. 1B is a plan view illustrating an example of a processing target tube.

As illustrated in FIG. 1B, the processing target tube Ta is a straight metal tube T that is formed with a ring-shaped projection Pr at each end portion thereof and that has two flare nuts F mounted to the outer periphery of the tube T so as to abut the ring-shaped projections Pr. The flare nuts F each include a thread portion Fa where a male thread is formed and a head portion Fb for input of fastening torque adjacent to the thread portion Fa. In the illustrated example the left and right flare nuts F have different axial direction dimensions to each other. The metal tube T of the processing target tube Ta is covered by a covering layer C of a resin material, with the covering layer C being peeled off up to specific ranges R1, R2 from each terminal end so as to match the dimensions of the flare nuts F to be mounted. After peeling off the covering layer C, terminal end processing is performed so as to form the ring-shaped projections Pr while in a state mounted with the flare nuts F.

Figure 2:
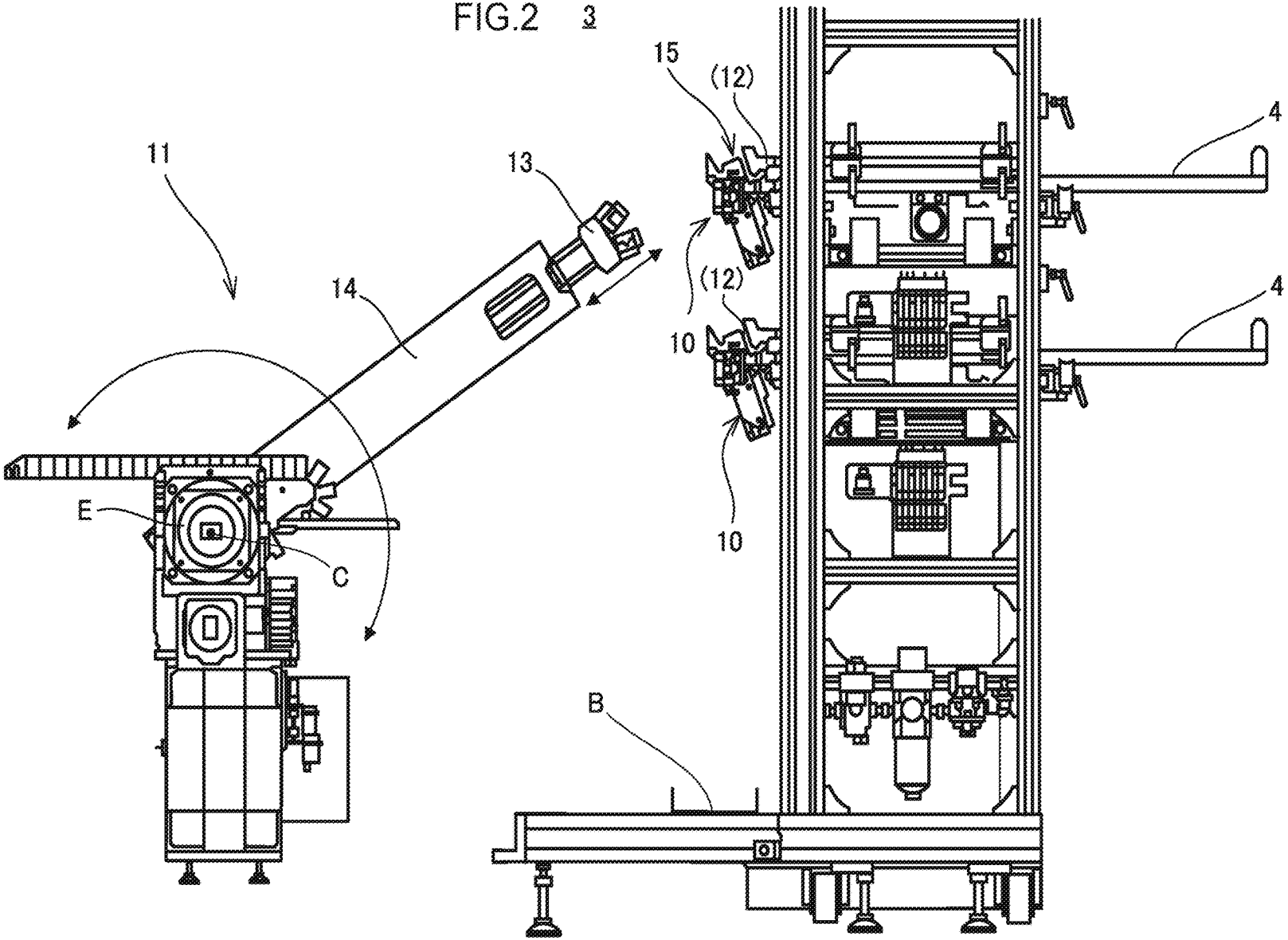
FIG. 2 is an example illustrating part of the system of FIG. 1A in a state as viewed from the direction of arrow II.

As illustrated in FIG. 1A and FIG. 2, the tube delivery unit 3 includes shift-to-end mechanisms 10 that perform a flare nut F shift-to-end manipulation on the processing target tube Ta, a transport mechanism 11 to transport the processing target tube Ta to the bending machine 2 after the shift-to-end manipulation has been performed thereon, and inspection mechanisms 12 that utilize action of the shift-to-end mechanisms 10 to detect an abnormality of the processing target tube Ta to be bent by the bending machine 2. The transport mechanism 11 includes a hand 13 for gripping the processing target tube Ta after the shift-to-end manipulation and inspection have been completed. The hand 13 is provided so as to be capable of extending and retracting with respect to an arm 14 as indicated by the arrow. The arm 14 is driven so as to be rotated by an electric motor E about a rotation center C. A processing target tube Ta not detected as abnormal by the inspection mechanisms 12 is passed across to the bending machine 2 using the transport mechanism 11. However, a processing target tube Ta detected as abnormal is collected by the transport mechanism 11 in a defective product box B that is provided within an operation range of the transport mechanism 11 and that serves as an example of a collection means.

The shift-to-end manipulation by the shift-to-end mechanisms 10 is a manipulation performed on the processing target tube Ta as illustrated in FIG. 1B, to move the two flare nuts F toward the end sides of the processing target tube Ta, such that one of the two flare nut F abuts one of the two ring-shaped projections Pr and the other of the two flare nuts F abuts the other of the two ring-shaped projections Pr. The shift-to-end manipulation is performed for bending due to the flare nuts F being in a state able to move in the axial direction, not fixed to the tube. As illustrated in FIG. 1A and FIG. 2, the shift-to-end mechanisms 10 include a first set of a pair of reception sections 15 disposed at an upper level, and a second set of a pair of reception sections 15 disposed at a lower level. The pairs of reception sections 15 respectively provided at the upper and lower levels are settable with a freely selected separation therebetween. For example, as in the illustrated example, setting a narrow separation between the pair of reception sections 15 disposed at the upper level and a wide separation between the pair of reception sections disposed at the lower lever, enables two types, i.e. a long type and a short type, of processing target tube Ta to be transferred, and enables bending to be performed alternately on the long type and short type processing target tubes Ta. The inspection mechanisms 12, described in detail later, are installed to each of the reception sections 15. The shift-to-end mechanisms 10 and the reception sections 15 arranged in this manner have the same left-right symmetrical structures as each other. These will be described below without particular discrimination therebetween, unless there is a need to discriminate therebetween.

Figure 3:
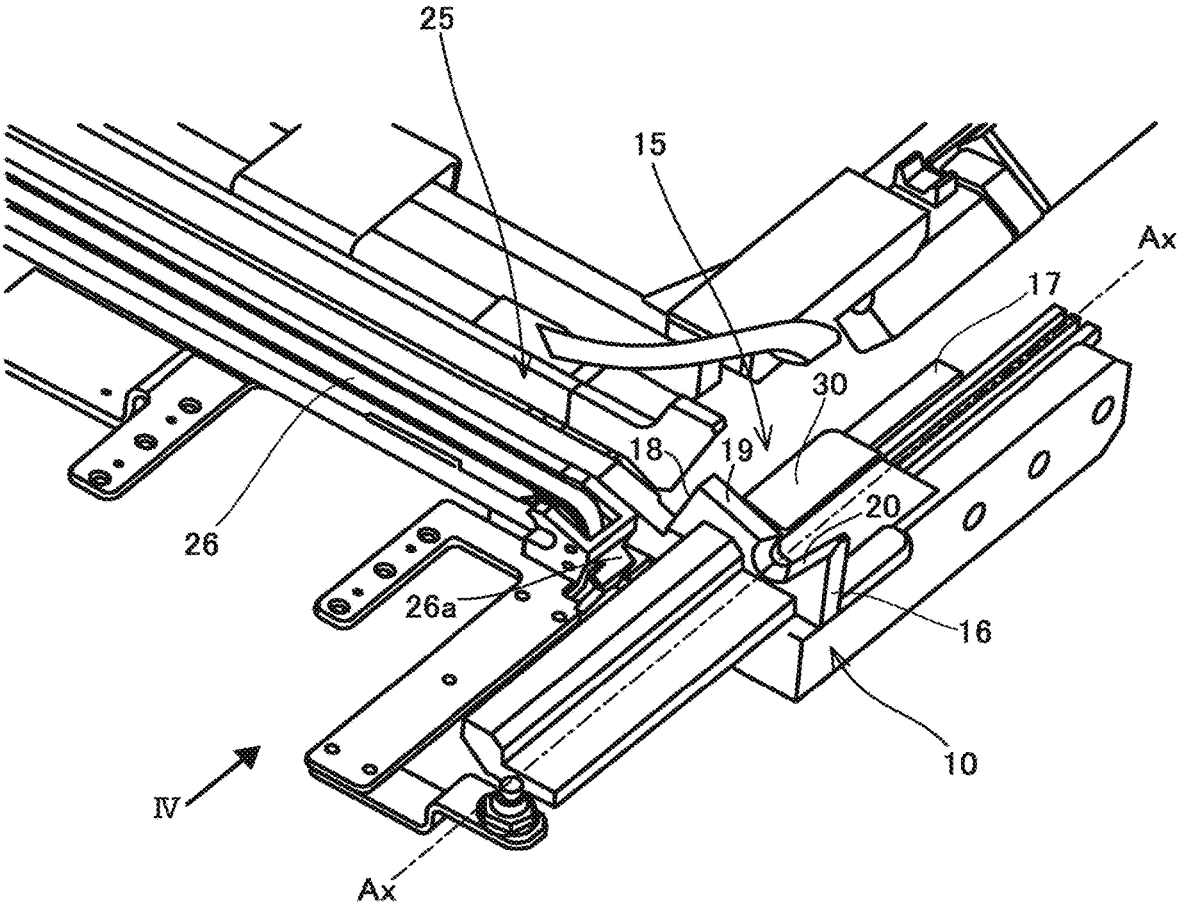
FIG. 3 is a perspective view illustrating part of relevant configuration of a reception section.
Figure 4:
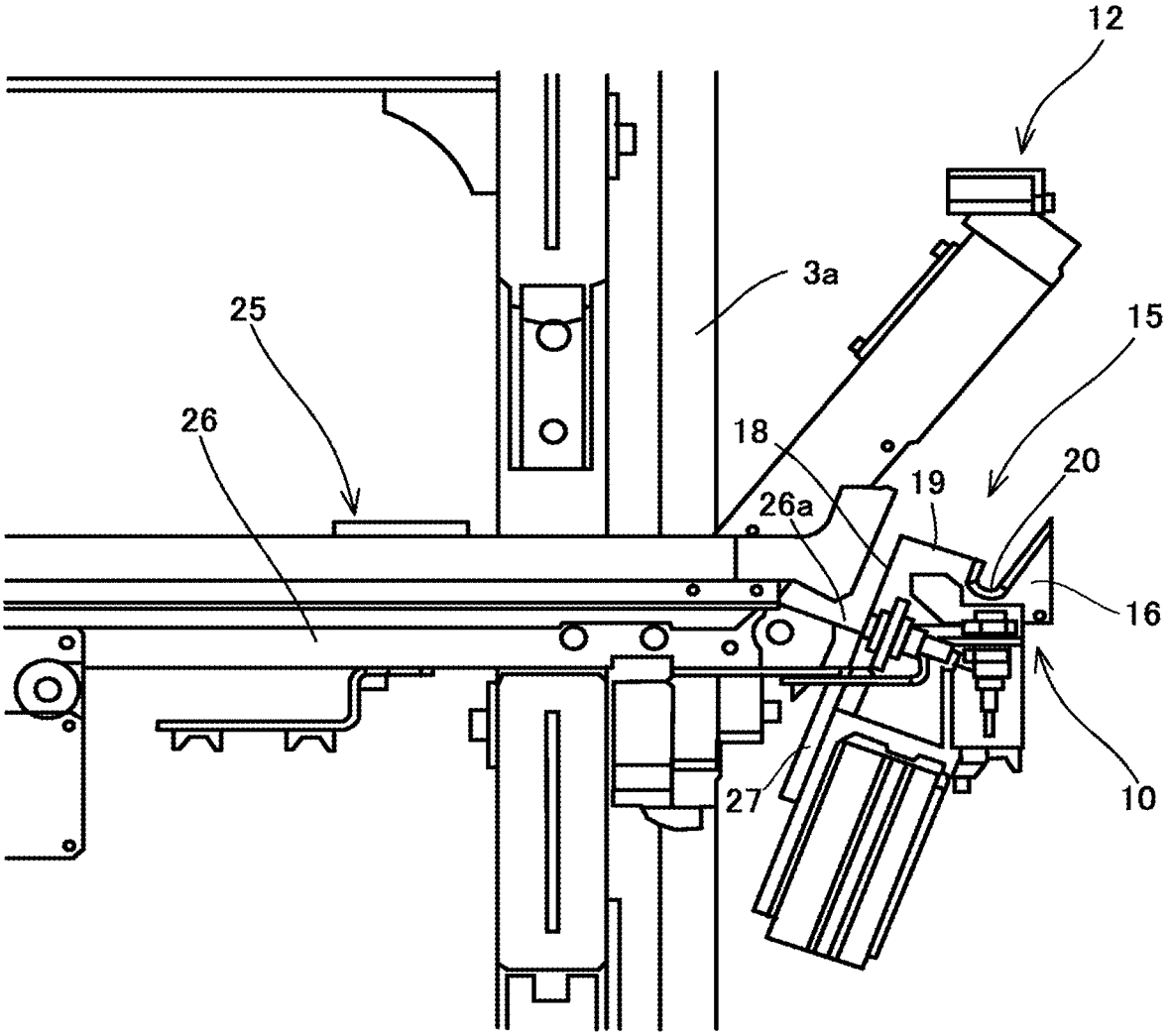
FIG. 4 is a diagram illustrating the reception section of FIG. 3 in a state as viewed from the direction of arrow IV.

As illustrated in FIG. 3 and FIG. 4, the reception sections 15 each include a tube reception plate 16 that widens in a direction perpendicular to an axial line Ax direction and that disposed in a state so as to be able to move in the axial line Ax direction, and an actuator 17 that drives the tube reception plate 16 in the axial line Ax direction. The actuator 17 is also provided to the other reception section 15, and is able to drive the tube reception plate 16 in the same direction. The tube reception plate 16 corresponds to an example of a tube reception member. Moreover, a combination of the two actuators 17 that are provided one each to the pair of reception sections 15 corresponds to an example of a drive means according to the present disclosure.

The tube reception plate 16 includes a first inclined portion 18 having a straight line shape inclined toward a side of the bending machine 2 (right side of FIG. 4) with respect to the up-down direction, and a second inclined portion 19 orthogonal to the first inclined portion 18. A groove shaped pocket 20 is formed in the second inclined portion 19 for receiving a single processing target tube Ta. A width of the pocket 20 is slightly larger than an outer diameter of the processing target tube Ta, and is smaller than an outer diameter of the flare nut F. Thus the shift-to-end manipulation can be performed to shift each of the flare nuts F toward the end side of the processing target tube Ta by moving each of the tube reception plates 16 in directions relatively away from each other in a state in which each of the pair of tube reception plates 16 has been disposed at the opposite side of the flare nuts F from the ring-shaped projections Pr. The pocket 20 corresponds to an example of a reception groove.

Figure 5:
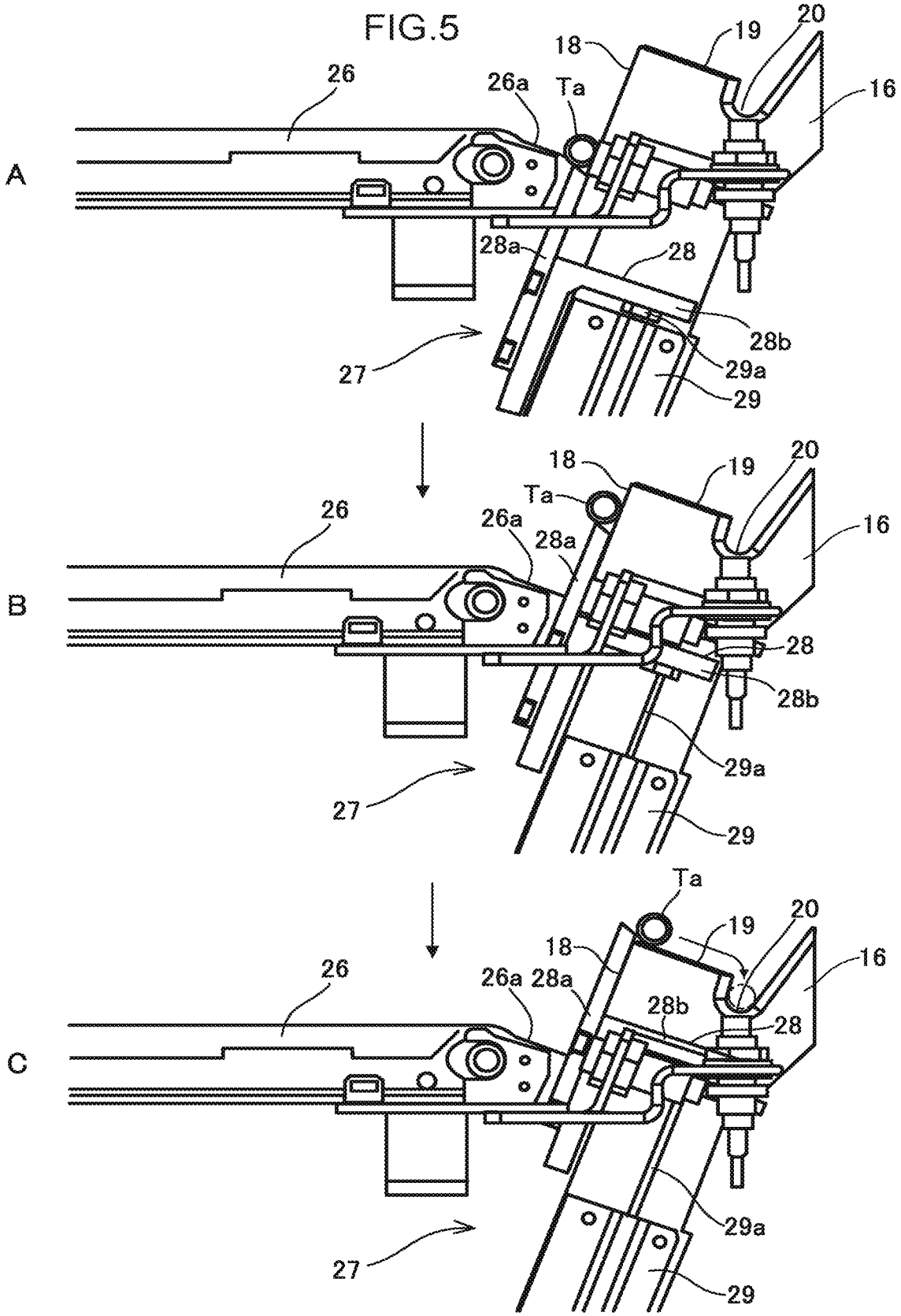
FIG. 5 are side views to explain operation of a delivering mechanism.

As illustrated in FIG. 3 to FIG. 5, the processing target tube Ta transferred into the tube input section 4 (FIG. 1A and FIG. 2) is fed by a feed mechanism 25 to the reception sections 15 of the shift-to-end mechanisms 10. The feed mechanism 25 includes a belt conveyor 26 provided adjacent to the tube input section 4, and a delivery mechanism 27 to deliver the processing target tubes Ta transported in by the belt conveyor 26 to the shift-to-end mechanisms 10 one tube at a time.

As illustrated in FIGS. 5, the delivery mechanism 27 includes a slide member 28 that is disposed between an output port 26*a* of the belt conveyor 26 and the reception section 15 and that is a moveable member able to move along the first inclined portion 18 of the tube reception plate 16, and an actuator 29 that drives the slide member 28.

The slide member 28 includes a first portion 28*a* extending along the first inclined portion 18, and a second portion 28*b* extending perpendicularly from the first portion 28*a*, so as to form a substantially sideways facing T-shape overall. The second portion 28*b* is coupled to the drive rod 29*a* of the actuator 29. The thickness of the first portion 28*a* is set so as to be not more than the outer diameter of the processing target tube Ta. This means that, as illustrated in FIG. 5A and FIG. 5B, a single processing target tube Ta alone is placed on a leading end portion of the first portion 28*a* of the slide member 28 and lifted up along the first inclined portion 18 when the slide member 28 is moved along the first inclined portion 18 in a state in which the processing target tubes Ta have been guided to the leading end portion of the first portion 28*a* of the slide member 28 that is on standby at a position lower than the belt conveyor 26. The leading end portion of the first portion 28*a* is inclined downward on the first inclined portion 18 side. This means that reaction force to weight on the processing target tube Ta is a reaction force from the first portion 28*a* acting toward the side of the first inclined portion 18. The processing target tube Ta is accordingly not liable to move away from the first inclined portion 18, and is suppressed from falling off while the processing target tube Ta is being moved. As illustrated in FIG. 5C, when the first portion 28*a* of the slide member 28 having the processing target tube Ta placed thereon reaches an upper end of the first inclined portion 18, the processing target tube Ta rolls over the second inclined portion 19 of the tube reception plate 16 in the direction of the arrow and enters the pocket 20.

Figure 6:
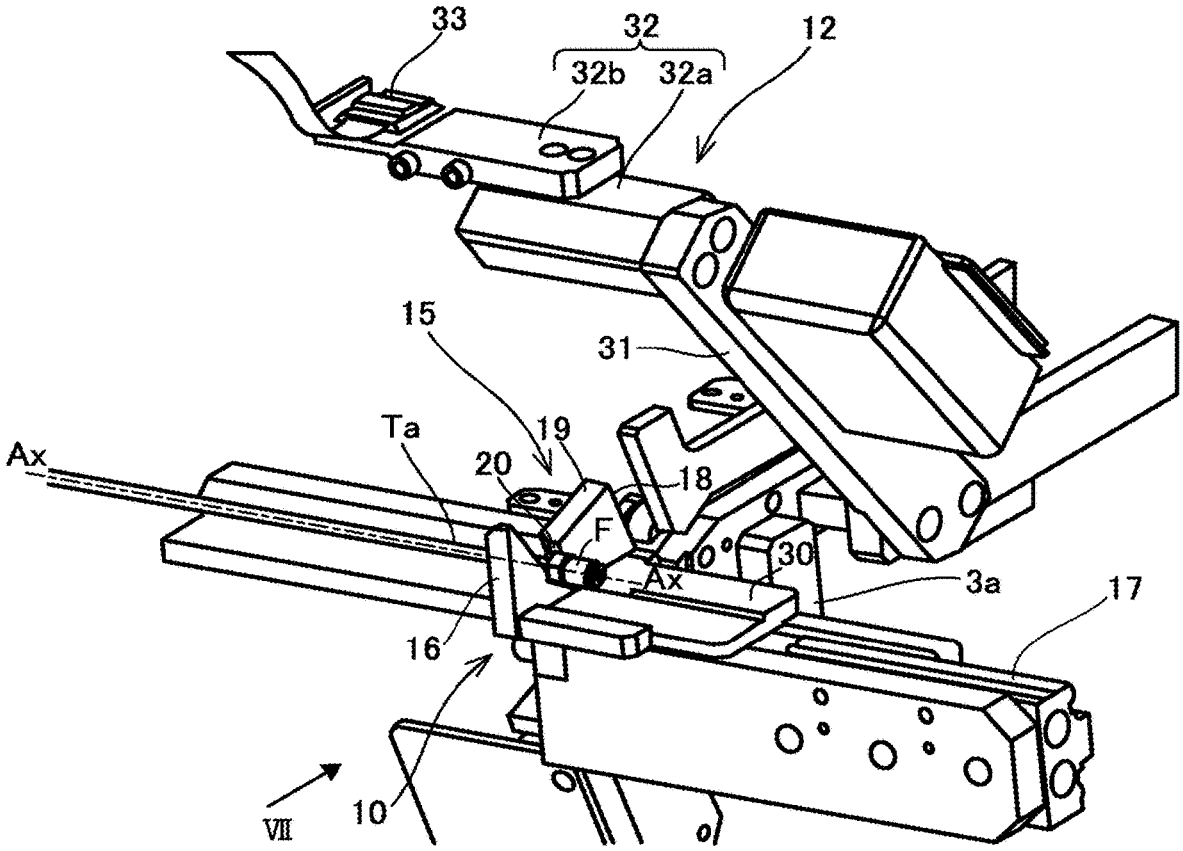
FIG. 6 is a perspective view illustrating a state in which a processing target tube is being inspected by an inspection mechanism.
Figure 7:
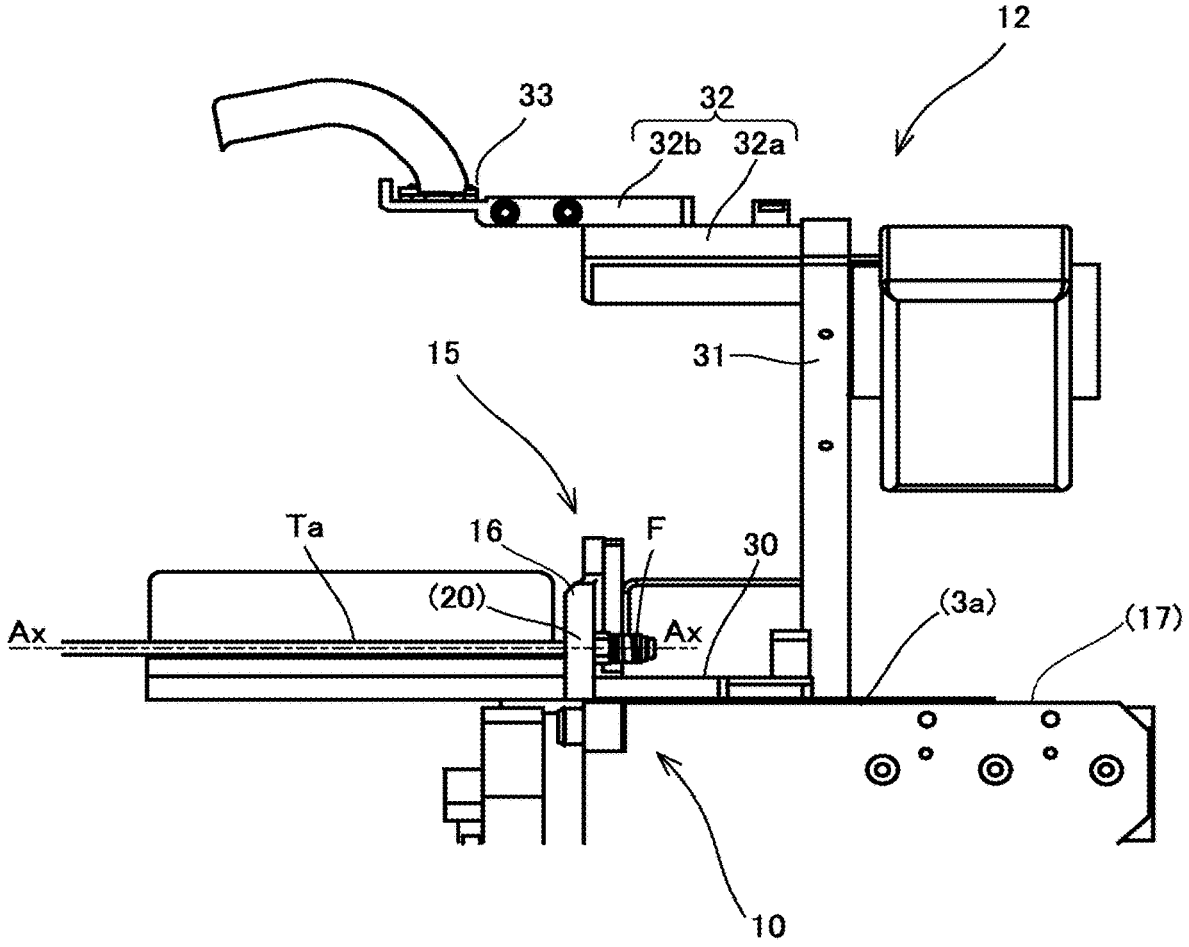
FIG. 7 is a diagram illustrating a state viewed from arrow VII direction of FIG. 6.

As illustrated in FIG. 6 and FIG. 7, when the processing target tube Ta enters the pocket 20, one of the shift-to-end mechanisms 10 moves the tube reception plate 16 toward the right side of FIG. 7, and the non-illustrated other shift-to-end mechanism 10 on the opposite side completes shift-to-end manipulation by pulling the processing target tube Ta in the opposite direction. The inspection mechanisms 12 are provided to the reception sections 15 to detect abnormalities of the processing target tube Ta.

The inspection mechanisms 12 each include a stage 30 fixed to a frame 3*a* of the tube delivery unit 3, an arm 31 extending diagonally upward from the frame 3*a*, a bracket 32 extending from the arm 31 in the axial line Ax direction, and a digital camera 33 fixed to the bracket 32 and facing toward the stage 30. The bracket 32 includes a main body 32*a* fixed to the arm 31, and a camera mount 32*b* fixed to the main body 32*a*. The digital camera 33 corresponds to an example of an image capture means. Both the stage 30 and the digital camera 33 are fixed to the common frame 3*a*, and so the positional relationship is fixed between the stage 30 and the digital camera 33. The tube reception plate 16 of the shift-to-end mechanism 10 is able to move as far as a specific position on the stage 30. This means that the processing target tube Ta is positioned on the stage 30 when the shift-to-end manipulation has been completed by the shift-to-end mechanism 10.

Figure 12:
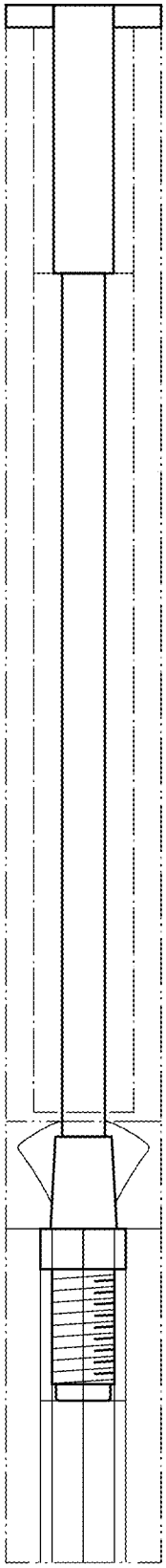
FIG. 12 is an example of a display of image data used in inspection.

The digital camera 33 captures an image capture range set to a range including the flare nut F of the processing target tube Ta positioned on the stage 30, and outputs image data acquired by such image capture. FIG. 12 illustrates an example of the output image data displayed on a display.

Figure 8:
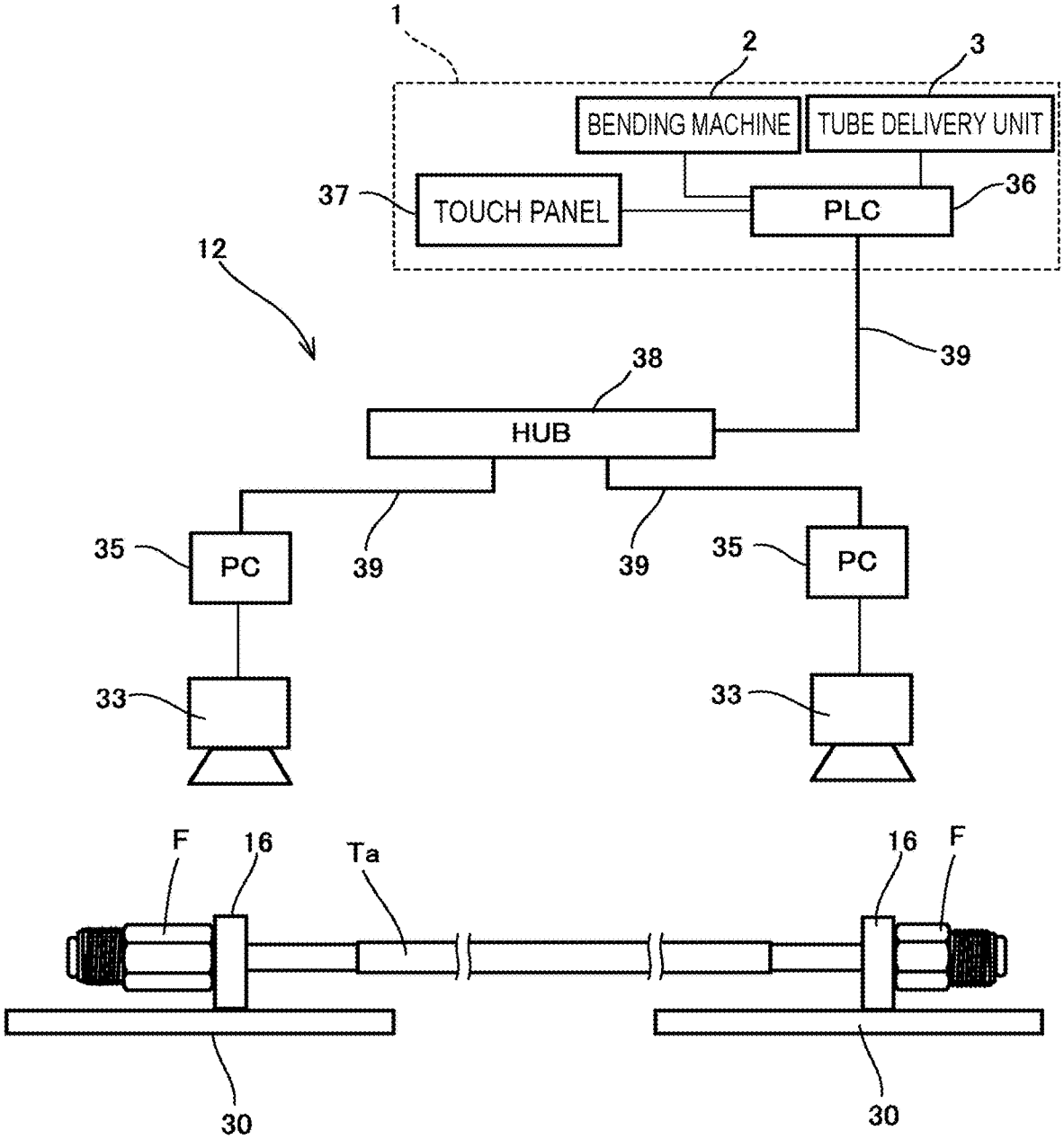
FIG. 8 is a diagram illustrating a system configuration of an inspection mechanism.

As illustrated in FIG. 8, the inspection mechanism 12 further includes a personal computer (PC) 35 provided for each digital camera 33, and the PCs 35 process the image data acquired by the digital cameras 33 to detect an abnormality of the processing target tubes Ta. A programmable logic computer (PLC) 36 is provided to the processing system 1 as a computer to control each section, such as the bending machine 2, and the shift-to-end mechanisms 10 and the transport mechanism 11 of the tube delivery unit 3. A touch panel 37 is connected to the PLC 36, and the PLC 36 appropriately receives manipulations by an operator through the touch panel 37. Each of the PCs 35 is connected via a hub 38 to the PLC 36 through communication cables 39, and various information is exchanged between the PCs 35 and the PLC 36 based on a specific logic. The inspection mechanism 12 is accordingly able to execute inspection of the processing target tube Ta linked to the shift-to-end manipulation performed by the shift-to-end mechanism 10.

Description follows regarding inspection performed by the inspection mechanism 12. The inspection mechanism 12 detects (1) a tube delivery abnormality caused by mis-delivery when the tube delivery unit 3 has received the processing target tube Ta with reversed left-right orientation, and (2) a nut mounting direction abnormality caused by the flare nut F being mis-assembled by being mounted with respect to the ring-shaped projection Pr with the opposite orientation from a correct direction. Note that one or other of (1) or (2) may also be performed.

(1) Tube Delivery Abnormality Detection

The following two method are examples of a tube delivery abnormality detection method.

(a) Abnormality Detection Based on Peeled Range of Covering Layer C.

As illustrated in FIG. 1B, the peeled ranges R1, R2 of the processing target tube Ta are different on the left and right. Discrimination can accordingly be made between whether the tube delivery unit 3 has received the processing target tube Ta in the correct orientation or has received the processing target tube Ta in the reversed orientation by identifying a boundary position P1 between one peeled range R1 and an un-peeled range R, and a boundary position P2 between the other peeled range R2 and the un-peeled range R. It is sufficient to identify the position of one out of the boundary positions P1 or P2, since knowing that one out of the boundary positions P1 or P2 is in a different position to the correct position means that the other thereof is also in a different position. Note that where there is no need to discriminate in the following description between the boundary position P1 and the boundary position P2, the boundary position P1 will be employed as representative thereof.

The PC 35 identifies a number of the pixel in the image data at the boundary position P1 based on image data acquired by the digital camera 33, and detects as a tube delivery abnormality a case in which there is a difference in comparison of this pixel position against a stored correct pixel position that was acquired in advance. As described above, the positional relationship between the digital camera 33 and the stage 30 is fixed, and so the processing target tube Ta is positioned on the stage 30 by the shift-to-end manipulation of the shift-to-end mechanism 10. This means that it is sufficient to compare the pixel position of the boundary position P1 against the correct pixel position without measuring the length of the peeled range R1.

A method by which the PC 35 identifies the pixel position of the boundary position P is set out below.

(a1) Gray scale conversion is performed to remove color elements of the image data. Brightness values of pixels are then stored for each pixel of the grey scale image data. The brightness values here are the pixel values of the grey scale image. Note that luminance is employed for the brightness value when a color image is employed.

Figure 9:
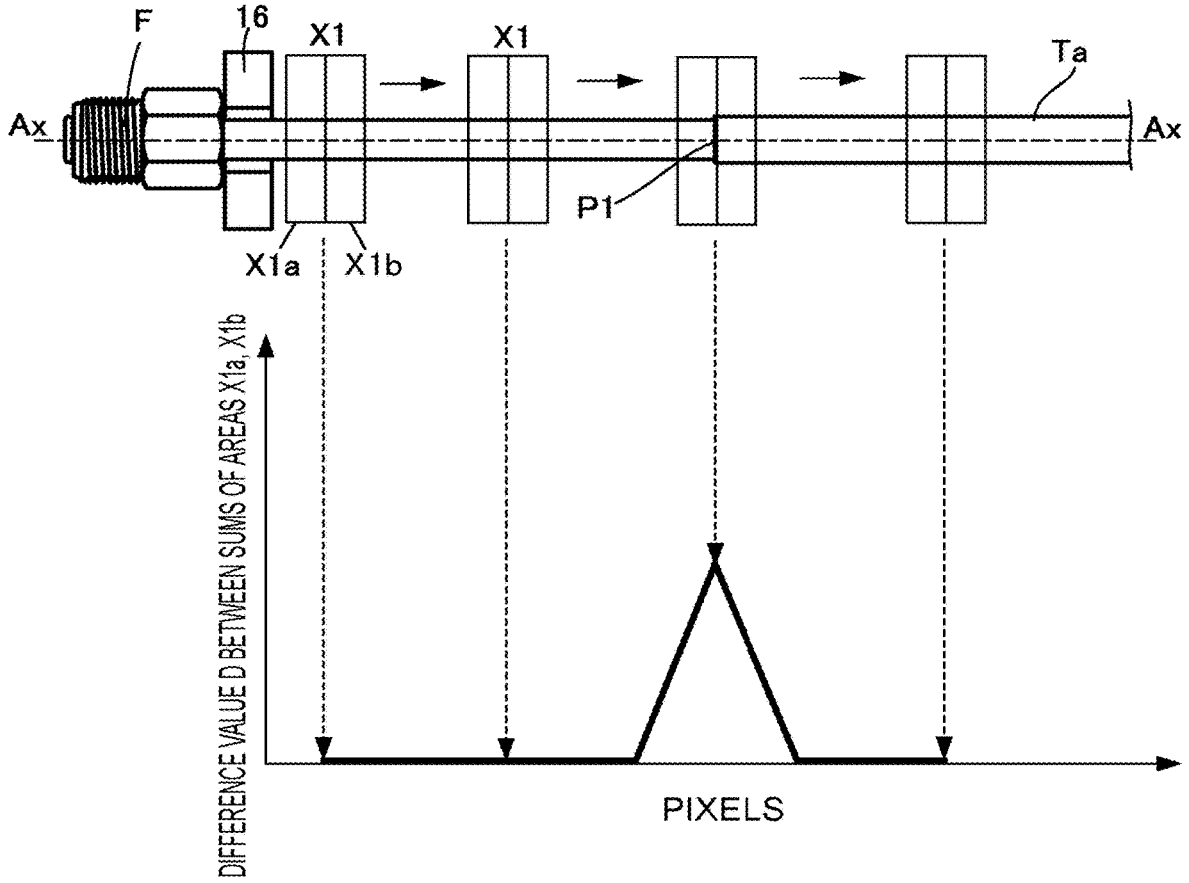
FIG. 9 is a diagram illustrating an example of a method to detect a tube delivery abnormality.

(a2) As illustrated in FIG. 9, a rectangular area X1 is set in the image data over the processing target tube Ta, the area X1 is divided into two equal left-right portions to give an area X1*a* and an area X1*b*.

(a3) A sum of the brightness values for the pixels in each area is computed for each of the areas X1*a*, X1*b*. A difference value D between the sum of the area X1*a* and the sum of the area X1*b* is computed. There is hardly any difference between the brightness values of image data between the area X1*a* and the area X1*b* when the boundary position P1 is not present in the area X1. This means that the difference value D between the totals of the areas X1*a*, X1*b* is close to zero.

(a4) The difference value D is computed according to above (a3) while shifting the rectangular area X1 along the processing target tube in the axial line Ax direction. This results in a change in the difference value D such as illustrated in the graph of FIG. 9.

(a5) The difference value D is a maximum value at the point when the center of area X1 coincides with the boundary position P1, and so the pixel position having a maximum value for the difference value D computed according to above (a4) is identified as the pixel position of the boundary position P1.

(b) Abnormality Detection Based on Terminal End Position of Processing Target Tube Ta The processing target tube Ta is positioned on the stage 30 by the shift-to-end manipulation of the shift-to-end mechanisms 10. This means that a terminal end position P3 (see FIG. 10) of the processing target tube Ta on the stage 30 is uniquely decided by an axial direction dimension of the mounted flare nut F. Suppose that a flare nut F having a different axial direction dimension was present due to misdelivery of the processing target tube Ta with the left-right reverse orientation, then the terminal end position P3 on the stage 30 would differ from that of normal delivery. This feature can be utilized to identify a number of pixel in the image data for the terminal end position P3, and cases in which there is a difference in a comparison of this pixel position against a stored correct pixel position of the terminal end position P3 acquired in advance are detected as being a tube delivery abnormality. Similarly to in the abnormality detection of above (a), it is sufficient to identify one terminal end position P3 of the processing target tube Ta since when there is a difference from the correct position at the one terminal end position P3 this means that there is a difference from the correct position at the other terminal end position P3.

A method by which the PC 35 identifies the pixel position of the terminal end position P3 is set out below.

(b1) Gray scale conversion is performed to remove color elements of the image data. Brightness values of pixels are then stored for each pixel of the grey scale image data.

Figure 10:
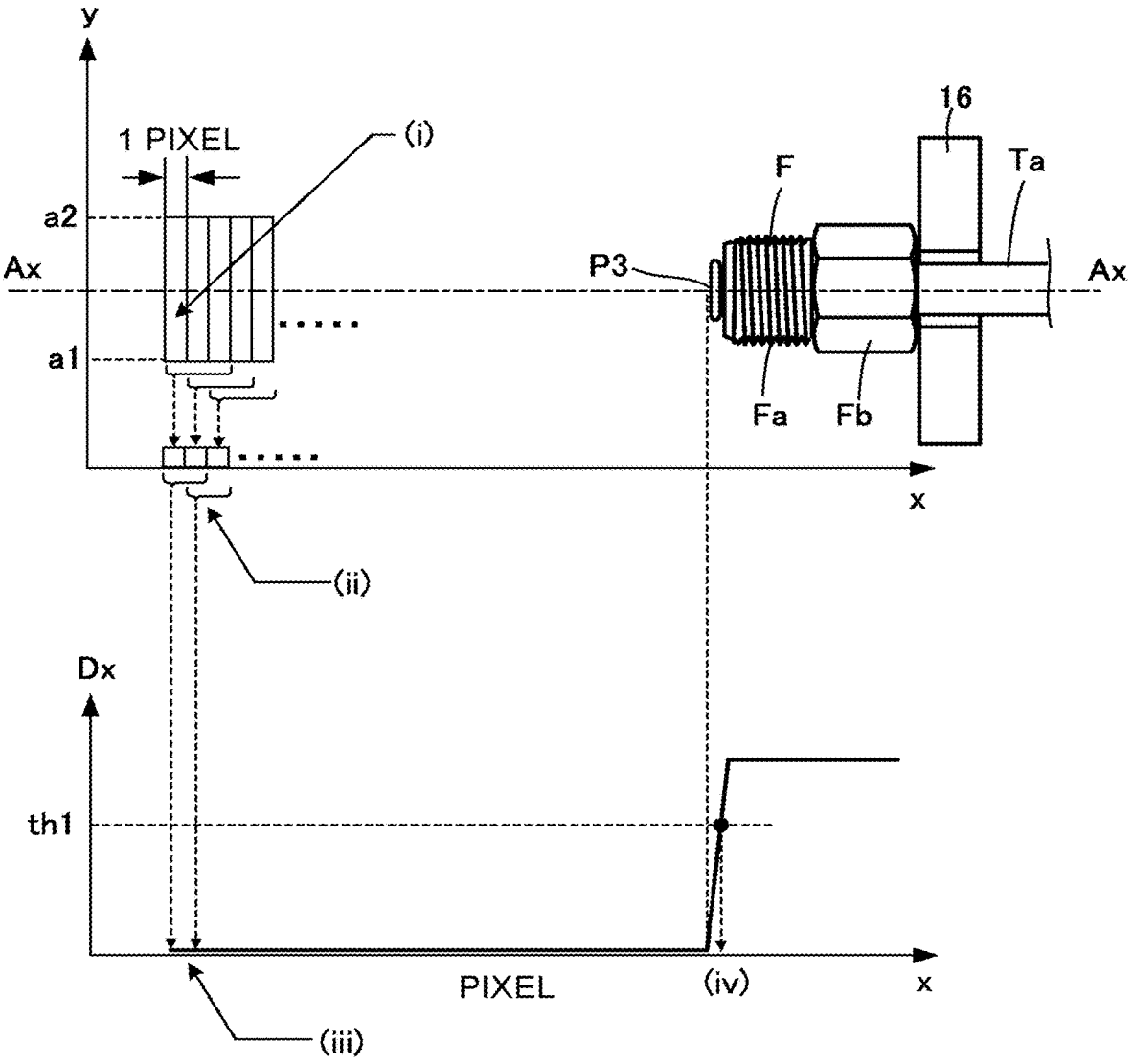
FIG. 10 is a diagram illustrating another example of a method to detect a tube delivery abnormality.

(b2) As illustrated at (i) in FIG. 10, the axial line Ax is set as an x axis, and a direction perpendicular to the x axis direction is set as a y axis. A total sumx is then computed along the y axis direction for brightness values Pxy of pixels in a range from a1 to a2 covering the flare nut F. The total sumx is expressed by Equation 1.

$$sum_x = \sum_{y=a1}^{a2} p_{xy} \quad (1)$$

(b3) As illustrated at (ii) in FIG. 10, smoothing processing is performed on the image data in the x axis direction. More specifically, an average of a total sumx is taken for 3 pixels. This average value smoothx is expressed by Equation 2.

$$\text{smooth}_x = \frac{sum_{x+0} + sum_{x+1} + sum_{x+2}}{3} \quad (2)$$

(b4) As illustrated at (iii) in FIG. 10, a difference value Dx is computed for the average value smoothx. The difference value Dx is expressed by Equation 3.

$$D_x = \text{smooth}_{x+1} - \text{smooth}_{x+0} \quad (3)$$

(b5) As illustrated at (iv) in FIG. 10, a pixel position corresponding to terminal end position P3 of the processing target tube Ta is identified at the point where the difference value Dx has become larger than a specific threshold th1.

(2) Nut Mounting Direction Abnormality Detection

A nut mounting direction abnormality is detected by identifying the thread portion Fa of the flare nut F, which is where there are thread peaks and troughs, based on information about light and dark in the image data, and by identifying whether the side of the thread portion Fa is on the leading end side of the processing target tube Ta or on the opposite side thereto. In other words, the image data is partitioned into an outside area on the leading end side of the processing target tube Ta and an inside area on the opposite side thereto, a variation in brightness values in the outside area and a variation in brightness values in the inside area are compared, and whether or not the thread portion Fa is present on the outside area side is inferred based on a magnitude relationship between these variations, so as to detect a nut mounting direction abnormality. A specific example of such processing is set out below.

(a) Gray scale conversion is performed to remove color elements in the image data. Brightness values of pixels are then stored for each pixel of the grey scale image data.

Figure 11:
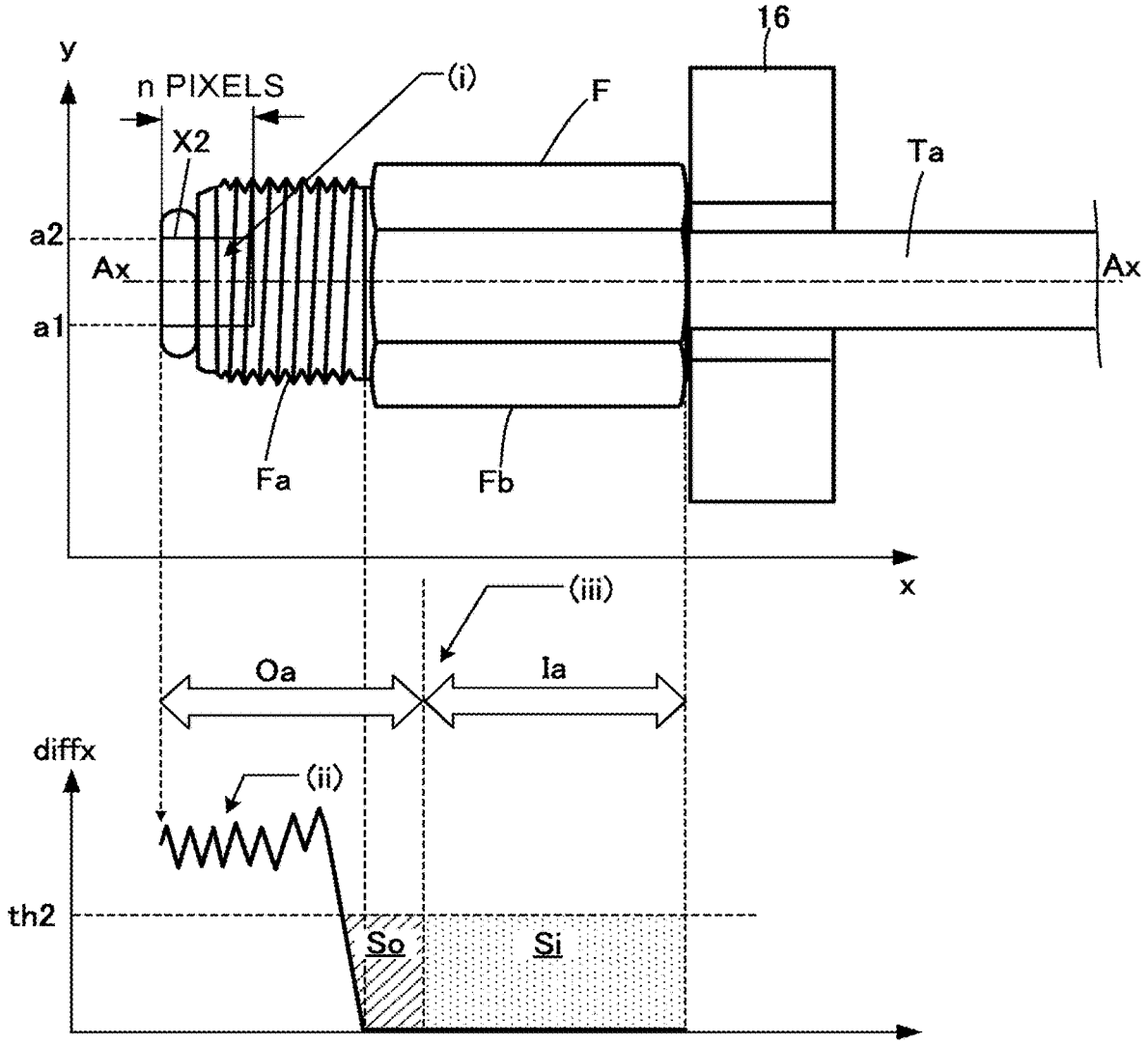
FIG. 11 is a diagram illustrating an example of a method to detect a nut mounting direction abnormality.

(b) As illustrated at (i) in FIG. 11, an area X2 of size n×(a2−a1) is set. Differences in brightness values are taken for pixels in the area X2 that are adjacent in the axial line Ax direction (x axis direction), and absolute values of all these differences are added together. This value represents a variation of light and dark in the area X2. The numerical value of this variation is greater the bigger the variation in light and dark between adjacent pixels. The variation diffx is expressed by Equation 4.

$$diff_x = \sum_{i=0}^{n} \sum_{y=a1}^{a2} |p_{x+i+0,y} - p_{x+i+1,y}| \quad (4)$$

(c) As illustrated at (ii) in FIG. 11, variation diffx is computed for each area X2 while shifting the area X2 in the x axis direction along the image of the flare nut F, and data such as depicted in the graph of FIG. 11 is obtained.

(d) As illustrated at (iii) in FIG. 11, the data obtained at above (c) is partitioned into two equal parts at a center of the x axis direction, so as to give partitioned data on the leading end side as data belonging to an outside area Oa and partitioned data on the opposite side thereto as data belonging to an inside area Ia.

(e) For the variation diffx, a threshold th2 greater than zero and smaller than a variation in the thread portion Fa is set in advance. For a region less than the threshold th2, a surface area Sa belonging to the outside area Oa and a surface area Si belonging to the inside area Ia are computed.

(f) Data of variation diffx corresponding to the thread portion Fa has values greater than threshold th2. The surface area on the thread portion Fa side is accordingly small. This means that the mounting direction of the flare nut F can be inferred as correct in cases in which, in a comparison of a surface area So and a surface area Si on each side, the surface area So of the outside area Oa where the thread portion Fa should be present is smaller than the surface area Si of the inside area Ia. In other words, the thread portion Fa is inferred to be present on the inside area Ia side when the surface area So of the outside area Oa is greater than the surface area Si of the inside area Ia, and so a flare nut F mounted in the reverse orientation is detected as a nut mounting direction abnormality.

In above (d), the data obtained at above (c) is partitioned into two equal parts at a center in the x axis direction so as to set the outside area Oa and the inside area Ia, however this is merely an example of partitioning the data region into two equal parts. A distribution between the outside area Oa and the inside area Ia may be changed as appropriate according to a dimensional ratio between a head portion Fb and the thread portion Fa of the flare nut F that is anticipated as the inspection target.

The method of processing in above (e) and (f) is merely an example based on a magnitude relationship of variations by setting the threshold th2, and comparing a magnitude relationship of variations of brightness values respectively computed for the outside area Oa and the inside area Ia of a surface area of a region less than the threshold th2. For example, the presence of the thread portion Fa can be inferred without setting the threshold th2, by comparing an integral value of variation contained in the outside area Oa against an integral value of variation contained in the inside area. In such cases the mounting direction of the flare nut F is inferred to be correct in cases in which the integral value of the outside area Oa is greater than the integral value of the inside area Ia. In contrast thereto, the mounting direction of the flare nut is inferred to be incorrect in cases in which the integral value of the outside area Oa is less than the integral value of the inside area Ia.

Figure 13:
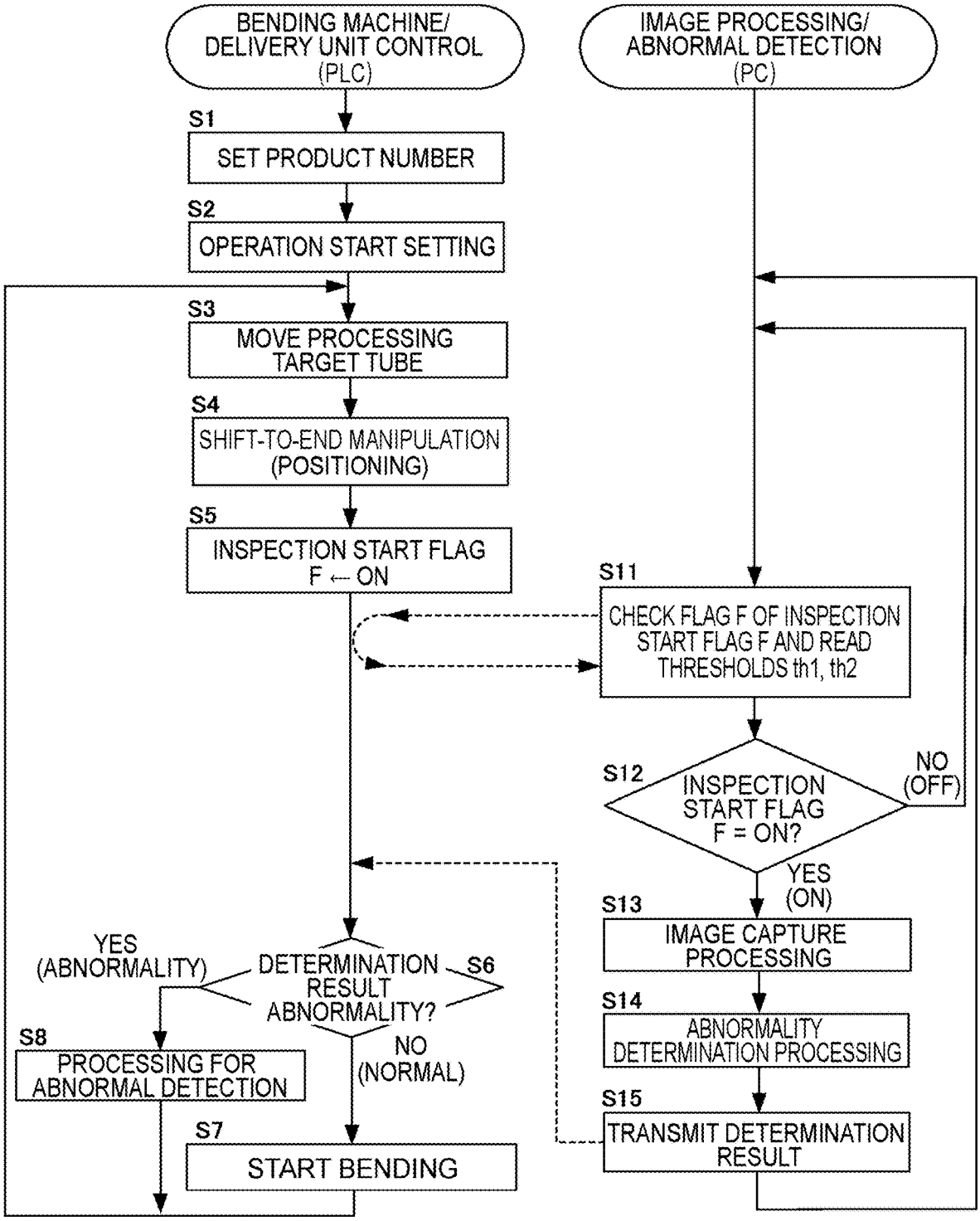
FIG. 13 is a flowchart illustrating an example of processing of a tube bending system.

Next, description follows regarding a flow of processing executed by the PCs 35 and the PLC 36, with reference to FIG. 13. The routine of FIG. 13 includes a routine executed by the PLC 36 to control operation of the bending machine 2 and the tube delivery unit 3 of the processing system 1, and a routine executed by the PCs 35 for actuation control and for image processing and abnormality determination processing of the inspection mechanism 12. These routines are executed in parallel by the PLC 36 and the PCs.

At step S1, the PLC 36 sets a product number allocated to each product to be bent in the processing system. At step S2, the PLC 36 performs operation start setting, searches a database in which product information is associated with the product numbers, and acquires information needed for bending, such as a profile identifying a bending shape.

At step S3, the PLC 36 controls the feed mechanism 25 of the tube delivery unit 3 so as to move a processing target tube Ta that has been transferred in by the tube input section 4 into the reception section 15 of the shift-to-end mechanisms 10 (see FIG. 3 to FIG. 5). Next, at step S4, the PLC 36 controls the shift-to-end mechanisms 10 so as to perform shift-to-end manipulation on the processing target tube Ta fed into the reception section 15. The processing target tube Ta is thereby positioned relative to the stage 30. Continuing to step S5, the PLC 36 sets ON for an inspection start flag F provided to manage start of inspection by the inspection mechanism 12.

In the other routine, at step S11 the PC 35 checks the content of the inspection start flag F and stores the content of the inspection start flag F. Then information needed for inspection is read corresponding to the product number that was set, such as for example pixel information related to a peel boundary position and pixel information related to a terminal end position, for a processing target tube Ta.

The PC 35 proceeds to processing of step S13 when the inspection start flag F is ON at step S12, and returns to processing of step S11 when the inspection start flag F is not ON at step S12. At step S13, the PC 35 controls the digital camera 33 so as to capture an image of the processing target tube Ta positioned on the stage 30.

At step S14, the PC 35 processes the image data acquired by the digital camera 33, and executes abnormality determination processing to detect for a tube delivery abnormality and a nut mounting direction abnormality as described above. Note that detection of tube delivery abnormalities can be executed both by a method based on the boundary of the peeled layer of the processing target tube Ta and a method based on the terminal end position thereof, or may be performed by one thereof. As a result of abnormality determination processing, the PC 35 holds a determination result of abnormal in cases in which at least one of these abnormalities has been detected, and holds a determination result of not abnormal in cases in which neither of these abnormalities has been detected. At step S15, the PC 35 transmits information of abnormal or not abnormal held as the determination result to the PLC 36.

At step S6, the PLC 36 references information related to the determination result received from the PC 35, and proceeds to step S7 when this is not abnormal, and proceeds to step S8 when this is abnormal. At step S7, the PLC 36 controls the transport mechanism 11 (see FIG. 2) so as to deliver the processing target tube Ta that has finished inspection to the bending machine 2, and also controls the bending machine 2 so as to bend the processing target tube Ta using the bending machine 2.

At step S8, the PLC 36 executes processing for abnormality detection. As the processing for abnormality detection, the PLC 36 controls the transport mechanism 11 such that the processing target tube Ta detected as abnormal is collected in the defective product box B (see FIG. 2), and also displays a warning display on a display device such as the touch panel 37 (FIG. 8). Note that audio information such as a warning sound may be output either instead of the warning display or together with the warning display.

The PC 35 functions respectively as an example of an image capture control means by executing the processing of step S11 to step S13 of FIG. 13, and as an example of an abnormality detection means by executing the processing of step S14 of FIG. 13.

Although an exemplary embodiment applied with the above present disclosure has been described with reference to the drawings, the present disclosure is not limited to such an exemplary embodiment, and various embodiments may be executed within a range of the spirit of the present disclosure.

Another embodiment of an shift-to-end mechanism may, for example, be an shift-to-end mechanism configured by a mechanism including an inclined member that is inclined downward such that the processing target tube is able to roll under its own weight and a guide member to guide the processing target tube rolling on the inclined member onto the stage while moving the flare nut toward the end side with respect to the processing target tube, with the mechanism able to guide the processing target tube onto the stage using the inclined member and the guide member, and able to position the processing target tube on the stage.

Aspects of the present disclosure identifiable from the above embodiment and modified examples thereof are disclosed below. Note that in order to facilitate understanding of the present disclosure, reference numerals and drawing numbers employed in the embodiment described above are given in brackets below, however there is no limitation to the shape, structure, and the like of the illustrated configurations.

An inspection method of the present disclosure is an inspection method having, as an inspection target, a flare nut attached tube (Ta) with a flare nut (F) including a thread portion (Fa) and a head portion (Fb) that should be mounted at an outer periphery of a metal tube (T) formed with a ring-shaped projection (Pf) at an end portion thereof by mounting in a correct direction with the thread portion side of the flare nut (F) abutting the ring-shaped projection. Image data obtained by capturing an image of an image capture range including the flare nut is partitioned into an outside area (Oa) on a leading end side and an inside area (Ia) on an opposite side, a variation of brightness values in the outside area is compared against a variation of brightness values in the inside area, and whether or not the thread portion is present on the outside area side is inferred based on a magnitude relationship between these variations so as to detect an abnormality of the flare nut mounted in a reversed orientation to a correct direction.

In this inspection method, the variations in brightness values in the image data are partitioned into two, and whether or not the thread portion is on the leading end side is able to be inferred by comparing a magnitude relationship between the variations in these areas. This enables a nut mounting direction abnormality to be detected by more simple processing than processing using image data to ascertain a feature such as a shape or dimension to discriminate between the thread portion and the head portion.

Note that the entire content of the disclosure of Japanese Patent Application No. 2021-064470 filed on Feb. 15, 2021 is incorporated by reference in the present specification.

All publications, patent applications and technical standards mentioned in the present specification are incorporated by reference in the present specification to the same extent as if each individual publication, patent application, or technical standard was specifically and individually indicated to be incorporated by reference.

The invention claimed is:

1. A tube bending system for bending a processing target tube into a predetermined shape, the processing target tube including a metal tube having two ring-shaped projections, respectively formed at each of two end portions of the metal tube, and including two flare nuts respectively mounted at an outer periphery of the metal tube so as to correspond to one or another of the two ring-shaped projections, the tube bending system comprising:

a bending machine that bends the processing target tube; and a tube delivery unit that receives the processing target tube and delivers the processing target tube to the bending machine, wherein the tube delivery unit includes:

a shift-to-end mechanism that performs a shift-to-end manipulation on the processing target tube to move the two flare nuts to the end portion sides of the processing target tube such that one of the two flare nuts abuts one of the two ring-shaped projections and the other of the two flare nuts abuts the other of the two ring-shaped projections; and an inspection mechanism that captures an image of a positioned state in which, by the shift-to-end manipulation, the flare nuts are abutted against the ring-shaped projections, and detects an abnormality based on a result of the imaging of the processing target tube that is to be bent in the bending machine.

2. The tube bending system of claim 1, wherein the inspection mechanism includes:

a stage on which the processing target tube positioned by the shift-to-end manipulation is disposed;

an image capture means that outputs image data obtained by capturing an image of an image capture range including the flare nuts set on the stage, and that has a fixed positional relationship to the stage;

an image capture control means that controls the image capture means so as to capture an image of the image capture range in a state in which the processing target tube is positioned on the stage; and an abnormality detection means that detects the abnormality of the processing target tube based on the image data.

3. The tube bending system of claim 2, wherein the shift-to-end mechanism includes:

a left-right pair of tube reception members that are each formed with a reception groove having a width that is larger than an outer diameter of the processing target tube and smaller than an outer diameter of a flare nut, that each receive the processing target tube at an opposite side of the flare nut from the ring-shaped projection, and that are movable in an axial direction; and a drive means configured to independently drive the left-right pair of tube reception members, wherein the processing target tube is positioned on the stage by moving one of the left-right pair of tube reception members to a specific position on the stage, and moving the other of the left-right pair of tube reception members in a direction away from the stage.

4. The tube bending system of claim 2, wherein:

the processing target tube is prepared as a product to be mounted with different types of flare nuts having mutually different axial directional dimensions as the two flare nuts, and as the abnormality, the abnormality detection means detects a tube delivery abnormality when the tube delivery unit has received the processing target tube in a state of reversed left-right orientation.

5. The tube bending system of claim 4, wherein the abnormality detection means detects the tube delivery abnormality by identifying a position of a terminal end of the processing target tube based on the image data.

6. The tube bending system of claim 4, wherein:

the processing target tube has a surface covered in a covering layer, and the covering layer is peeled off from respective terminal ends of the processing target tube by a different length at left and right in accordance with the respective axial directional dimensions of the two flare nuts; and based on the image data, the abnormality detection means detects the tube delivery abnormality by identifying a boundary position between a peeled range where the covering layer has been peeled off and a non-peeled range where the covering layer has not been peeled off.

7. The tube bending system of claim 2, wherein, as the abnormality, the abnormality detection means detects a nut mounting direction abnormality in which at least one of the two flare nuts has been abutted against the ring-shaped projection in a reversed orientation from a correct direction.

8. The tube bending system of claim 7, wherein:

each flare nut includes a thread portion formed with a male thread and a head portion adjacent to the thread portion, and the abnormality detection means detects the nut mounting direction abnormality by:

partitioning the image data including an image of the flare nut into an outside area at a leading end side and an inside area at an opposite side, comparing a variation of brightness values in the outside area against a variation of brightness values in the inside area, and inferring whether or not the thread portion is present on the outside area side based on a magnitude relationship between the respective variations.

9. The tube bending system of claim 1, wherein:

the tube delivery unit further includes a transport mechanism that transports the processing target tube to the bending machine after the shift-to-end manipulation, and the transport mechanism does not transport the processing target tube to the bending machine in a case in which the inspection mechanism has detected the abnormality and, instead, transports the processing target tube to a collection means provided within an operational range of the transport mechanism.

10. The tube bending system of claim 3, wherein:

the processing target tube is prepared as a product to be mounted with different types of flare nuts having mutually different axial directional dimensions as the two flare nuts, and as the abnormality, the abnormality detection means detects a tube delivery abnormality when the tube delivery unit has received the processing target tube in a state of reversed left-right orientation.

11. The tube bending system of claim 3, wherein, as the abnormality, the abnormality detection means detects a nut mounting direction abnormality in which at least one of the two flare nuts has been abutted against the ring-shaped projection in a reversed orientation from a correct direction.

12. The tube bending system of claim 2, wherein:

the tube delivery unit further includes a transport mechanism that transports the processing target tube to the bending machine after the shift-to-end manipulation, and the transport mechanism does not transport the processing target tube to the bending machine in a case in which the inspection mechanism has detected the abnormality and, instead, transports the processing target tube to a collection means provided within an operational range of the transport mechanism.

* * * * *